US005596611A

United States Patent [19]

Ball

[11] Patent Number: 5,596,611

[45] Date of Patent: Jan. 21, 1997

[54] MEDICAL ISOTOPE PRODUCTION REACTOR

[75] Inventor: Russell M. Ball, Lynchburg, Va.

[73] Assignee: The Babcock & Wilcox Company, New Orleans, La.

[21] Appl. No.: 339,264

[22] Filed: Nov. 10, 1994

Related U.S. Application Data

[63] Continuation-in-part of Ser. No. 986,939, Dec. 8, 1992, abandoned.

[51] Int. Cl.[6] ..... G21G 1/02

[52] U.S. Cl. ..... 376/189; 376/186; 376/311; 376/313; 376/358

[58] Field of Search ..... 376/186, 313, 376/354–358, 311, 189

[56] References Cited

U.S. PATENT DOCUMENTS

| | | | |
|---|---|---|---|
| 2,815,321 | 12/1957 | Wigner et al. | 376/356 |
| 2,860,093 | 11/1958 | Wigner et al. | 376/356 |
| 2,945,794 | 7/1960 | Winters et al. | 376/356 |
| 3,080,307 | 3/1963 | Rinald | 376/356 |
| 3,154,473 | 10/1964 | Martin | 376/358 |
| 3,284,305 | 11/1966 | Urey et al. | 376/356 |
| 3,830,746 | 8/1974 | Brown et al. | 376/186 |
| 4,017,583 | 4/1977 | Motojima et al. | 376/189 |
| 4,094,953 | 6/1978 | Hadi et al. | 376/186 |
| 4,532,102 | 7/1985 | Cawley | 376/356 |

FOREIGN PATENT DOCUMENTS

| | | | |
|---|---|---|---|
| 0592382 | 2/1960 | Canada | 376/358 |

OTHER PUBLICATIONS

*Fluid Fuel Reactors*, Addison–Wesley Pub. Co., Inc., Reading, Mass, (1958), edited by Lane et al, pp. 1–23, 40–45, 98–101, 112, 113, 330–337, 348–355, 516–523, 530–531.

*Primary Examiner*—Harvey E. Behrend
*Attorney, Agent, or Firm*—Robert J. Edwards

[57] ABSTRACT

Medical isotopes are produced using a lower power, low cost nuclear reactor which permits the use of all the fission products produced in the reactor. Medical isotopes such as Molybdenum-99 are produced in a reactor operating at a power of 100 to 500 kilowatts.

16 Claims, 1 Drawing Sheet

MEDICAL ISOTOPE PRODUCTION REACTOR

CROSS-REFERENCE TO RELATED APPLICATION

The present application is a continuation-in-part application of Ser. No. 07/986,939 filed Dec. 8, 1992, now abandoned.

FIELD AND BACKGROUND OF THE INVENTION

The present invention relates, in general, to methods and systems for separating isotopes from nuclear reactors, and in particular to a method employed in reactors and used for medical isotope production.

Beginning in 1945, nuclear reactors were used to produce medical isotopes employing various techniques. U.S. Pat. No. 4,487,738 teaches a method for producing a Cu isotope for diagnostic and experimental medical applications. The Cu isotope is produced by proton spallation combined with subsequent chemical separation and purification.

U.S. Pat. No. 3,914,373 discloses a method for separating isotopes by contacting a feed solution containing the isotopes with a cyclic polyether. This method has been applied to clinical, biological and medical research.

U.S. Pat. No. 4,158,700 discloses a method of producing radioactive Technetium-99m using a solution containing Molybdenum-99 and Technetium-99m in conjunction with a chromatographic column and eluting it with a neutral solvent system comprising an organic solvent for producing Technetium-99m as a dry, particulate residue.

U.S. Pat. No. 3,799,883 discloses dissolving uranium material in aqueous inorganic acid then precipitating Mo-99 using alpha-benzoinoxime.

An article entitled "Study of the Separation of Molybdenum-99 and Recycling of Uranium to Water Boiler Reactor" by W. L. Cheng, et al., *Appl. Radiot. Isot.*, Vol. 40, No. 4, pp. 315–324, 1989, teaches a process which includes the separation of Molybdenum-99 from uranium sulfate fuel solution with an α-benzoin oxime precipitation and purification by chelating ion exchanger, alumina, and calcium phosphate hydroxide as adsorbents.

Although the isotope Molybdenum-99 (Mo-99) is an isotope commonly used in the medical field, only one method exists for the production of medical isotopes such as Mo-99 that is approved by the United States Food and Drug Administration. This method comprises extracting the fission product, Mo-99, from a Uranium-235 target which has been irradiated in a neutron flux provided by a large nuclear reactor. Because these nuclear reactors are used for other purposes besides producing medical isotopes, the reactor power is high, usually 20,000 to 200,000 kilowatts. When producing medical isotopes this power output by the nuclear reactor is extremely wasteful.

SUMMARY OF THE INVENTION

The present invention comprises a low power, low cost method for use with a nuclear reactor, which extracts medical isotopes from the fission products produced by the reactor. The present invention is directed toward replacing nuclear reactors employing the reactor-target systems using reactors operating at a power of about 200 kilowatts (e.g. 100 to 300 kilowatts) for producing medical isotopes such as Mo-99.

Current reactors using the reactor-target system are operated at a power of 20,000 or more kilowatts when producing medical isotopes resulting in heat and radioactive waste of at least 100 times the basic requirement.

The present invention provides a method for producing medical isotopes such as Mo-99 from either an aqueous-homogeneous or water boiler reactor or from a gas-cooled reactor.

The present invention provides for the production of medical isotopes using a method for treating the fission products in either liquid or gas form through interaction with inorganic or organic chemicals in order to extract the medical isotopes.

An object of the present invention is to provide a nuclear reactor which can be dedicated solely to the production of medical isotopes using a simple and direct treatment procedure.

Another object of the present invention is to provide a method of medical isotope production which reduces the amounts of radioactive waste and heat dissipation by two orders of magnitude for each unit of medical isotope produced.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWING

The only drawing in the application is a schematic representation of a system used in accordance with the invention.

DESCRIPTION OF THE PREFERRED EMBODIMENTS

Figure 1:
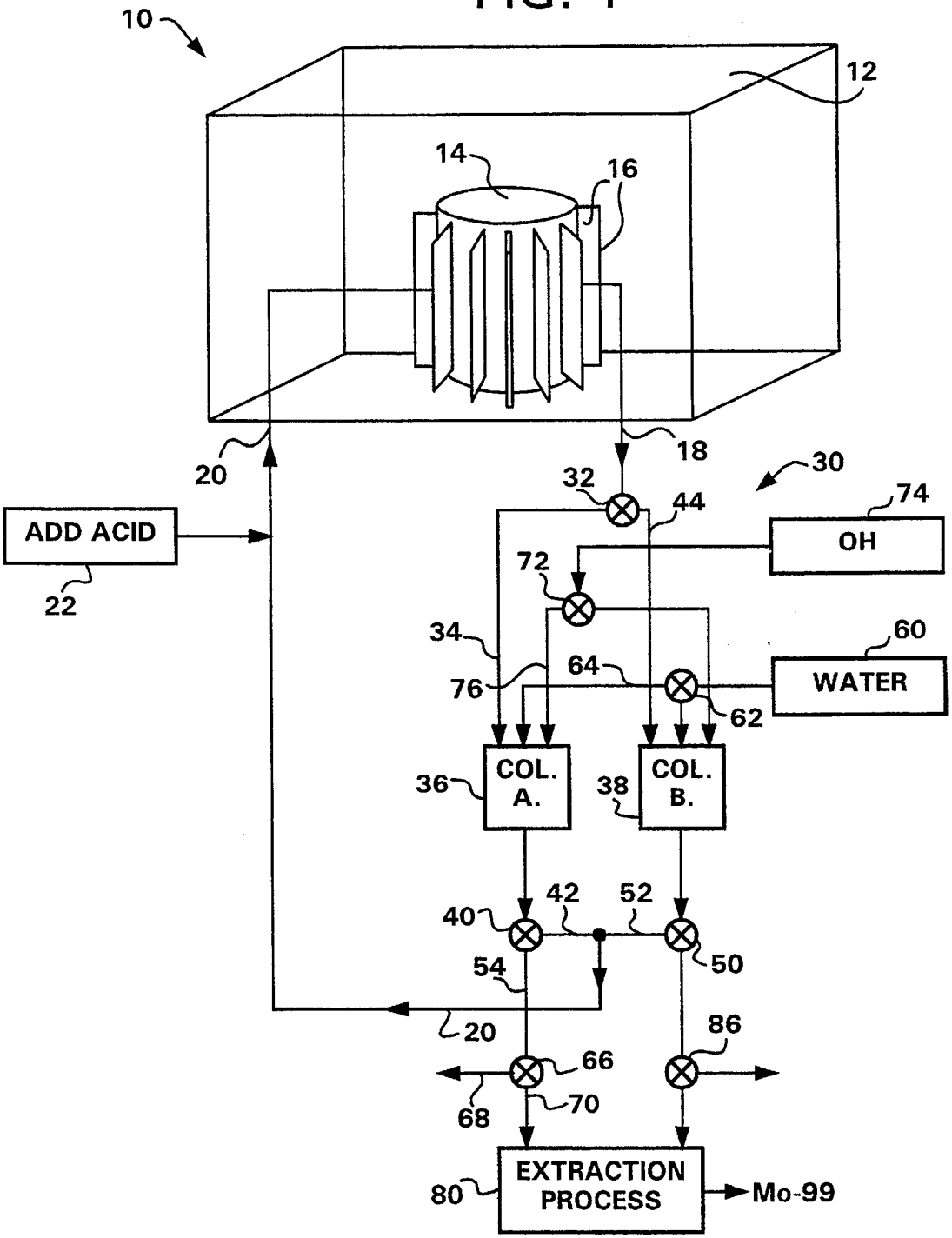

The present invention comprises a method for producing medical isotopes through the use of a small reactor wherein the fission products come out in the form of a liquid or gas. The reactor can be an aqueous-homogeneous or water boiler or a gas-cooled type reactor, wherein the fissionable material comprises U-235, Pu-239 or U-233.

The characteristics of the reactor used in conjunction with the present invention include the following: a power level near the 200 kilowatt range, 20 liters of uranyl nitrate solution containing approximately 1000 grams of U-235 in a 93% enriched uranium, and a container configured as an approximate right cylinder.

An alternate embodiment of the invention can use 100 liters of uranyl nitrate solution containing 20% U-235 rather than 93% enriched uranium.

For the aqueous-homogeneous or water boiler type reactor, the reactor uses a solution of uranium salts, i.e. uranyl nitrate in water contained within a reflected container. For the gas-cooled reactor, the fissionable material is supported on very thin foils or wires so that all fission products are released into the gas stream. The moderating material is separately deployed.

The extraction of the desired fission products for medical isotopes such as Mo-99 are provided by a method of the present invention comprising subjecting the uranyl nitrate solution or in the case of the gas-cooled reactor, the gas stream, to sorption columns of alumina for a period of time ranging from about 12 to about 36 hours. After the fission products have been circulated through the columns of alumina, these products are subjected to a subsequent purification with organic chemicals which can be in the form of an aqueous solution and, preferably, the reaction products are removed from the columns of alumina by elution with a sodium or ammonium hydroxide solution. After purification, the fission products are further processed by circulation through ion exchange columns to produce the resultant medical isotopes, such as Mo-99, attached to the material of the column.

Preferably, the resulting elutriant from the sodium hydroxide solution is precipitated with an organic chemical such as alpha-benzoinoxime which collects the Mo-99 by forming a precipitate, leaving other fission products in solution.

The precipitate (Mo-99) may again be dissolved and the process repeated for greater purity.

The uranyl nitrate solution is reused in the reactor by adding nitric acid in the solution to achieve a pH in a range of about 2 to about 5. After the nitric acid addition, the uranyl nitrate solution is passed back into the reactor for reuse without further processing.

Referring to the drawing, the system for practicing the present invention generally designated 10 comprises a container or enclosure shown schematically at 12 for containing a pool of water, for example, 3×3 meters by 7 meters high, in which a vessel 14 is immersed, for example, a 20 liter right cylindrical vessel having fins 16 for heat transfer to the pool of water to form passive cooling with enhanced safety and to remove dependency on active pumping. For the embodiment of the invention using 100 liters of solution containing a lower proportion of pure U-235, a larger pool can be used with the suitably larger cylindrical vessel. According to the present invention, a small amount of the uranyl nitrate, for example, at a rate of about 0.1 to 1.0 ml/second is removed from vessel 14 along a conduit 18. Eventually, this entire amount of solution is returned to vessel 14 through a return conduit 20, after acid, for example, nitric acid, has been added to the solution at 22, to bring the solution to a pH of about 2 to 5.

Within vessel 14, which forms the reactor, the solution forms the homogeneous fissionable material which, among other things, forms the Molybdenum-99, as well as other fission products such as iodine or palladium. The reactor with 20 liters volume in vessel 14 and 1000 grams of enriched uranium, is capable of generating about 200 kilowatts of power.

The Mo-99 extraction portion of the invention is generally designated 30 and includes a first valve 32 which is capable for diverting the 0.1 to 1.0 ml/second flow of uranyl nitrate solution either through a conduit 34 to an alumina column A, at numeral 36 or, in a second position, to a second alumina column B, shown at numeral 38.

When column 36 is being supplied with solution from line 18, a second valve 40 is positioned to pass the solution over a connecting conduit 42 to the return conduit 20.

According the present invention, the flow of solution over conduits 18, 34, 42 and 20, through column 36 and past valves 32 and 40, is maintained for about 12 to 36 hours during which Mo-99 and some of the other fission products attach to the alumina in column 36. After this time, the position of valve 32 is changed to divert the flow of solution to a conduit 44, which supplies the solution to the second column 38 and through a further valve 50 to a connecting conduit 52 and again, back to the return conduit 20. At the same time, valve 40 is rotated to disconnect column 36 from connecting conduit 42 and connect the outlet of column 36 to an outlet conduit 54. This is followed by a washing step of approximately 30 minutes during which water from a water supply 60 is supplied through a suitably positioned valve 62 to a washing conduit 64 for passing washing water through column 36, through valve 40, along outlet conduit 54, passed a further valve 66, to a drain line 68. This serves to wash away removed materials from column A which have not been fixed to the alumina.

After this washing period, valve 62 is rotated to close the flow of water to conduit 64 and valve 66 is rotated to divert flow to a further conduit 70. Another valve 72 connected to a source of hydroxide 74, for example, sodium hydroxide or ammonium hydroxide, is rotated to open a passage to a hydroxide conduit 76 for supplying hydroxide to and through column 36, passed valve 40 and from valve 66 to conduit 70 and extraction process shown only schematically at 80. The hydroxide serves to remove, that is elude Molybdenum-99 and other fission products from column 36. Subsequently, chemical processing in process 80 takes place by adding an organic solution such as alpha-benzoinoxime, which causes the Molybdenum-99 to form a precipitate, leaving the other fission products solution. The precipitate is then filtered. The precipitate may also be dissolved again and the process repeated for greater purity.

After the uranyl nitrate solution has passed for the suitable time period through column B at 38, the positions of valves 32, 62, 72, 40, 50 and an outlet valve 86 can be changed to suitably wash, extract, precipitate and optionally purify the Mo-99, from column 38. The use of two columns avoids wasted time while Mo-99 is being extracted from the other column.

While a schematic example of the valving and connections between the washing apparatus, the hydroxide apparatus and the extraction process are shown in the figure, any other suitable valving is also possible as long as the various function needed according to the invention can be achieved.

A second embodiment of the present invention is a method used in gas-cooled reactors wherein very small particles of fissionable material in the form of uranium metal or a uranium compound, such as uranium carbide or uranium oxide, are subjected to the fission process in the reactor. Typically, the uranium should be a U-235 isotope. These fine particles of fissionable material are cooled by a gas stream such as a helium-xenon mixture or another inert gas or carbon dioxide. The fission products produced, when the uranium fissions in the critical reactor, are taken up in the gas stream and removed from the reactor. This gas stream containing the fission products is passed through a gas adsorbing bed, such as activated charcoal or carbon, for adsorbing the fission products from the gas stream. The gas adsorbing bed can then be removed and the absorbed fission products separated from the absorbing bed through separation means such as heating, and in turn dissolved in an aqueous solution by a process such as bubbling the gas through the solution. The solution containing the fission products could then be treated by known conventional means such as passing the solution through an alumina column for collecting the medical isotopes like Mo-99.

A third embodiment of the present invention comprises a method wherein the fission products created, as described above, are mixed with carbon or other gas-adsorbing materials which, when heated by the fission fragments, elute the fission products into the gas stream for the separation treatment indicated above.

A fourth embodiment of the present invention comprises mixing the small particles of fissionable material with a moderating material such as small particles of polyethylene to act as a neutron moderator and catcher of fission products which are in turn taken into the gas stream and subjected to the separation treatment indicated above.

A fifth embodiment of the present invention comprises passing a solution of uranium salts through porous polyethylene rods such that the uranium salts adhere to the surface of the porous polyethylene. These rods are then assembled into a reactor configuration which can achieve critically. The uranium fissions and the fission products are then taken up into a gas stream which cools the reactor and sweeps out the fission products for the separation treatment indicated above.

While specific embodiments of the invention have been shown and described in detail to illustrate the application of the principles of the invention, it will be understood that the invention may be embodied otherwise without departing from such principles.

What is claimed is:

1. A method of collecting a medical isotope from a fission product produced in a nuclear reactor, the method comprising:

providing a reactor having a 100 to 300 kilowatt rating;

using a uranyl nitrate solution as a homogeneous fissionable material in the reactor, the fissionable material producing fission products including Molybdenum-99 in the uranyl nitrate solution;

passing a portion of the uranyl nitrate solution from the reactor to and through a column of alumina for fixing the fission products including Molybdenum-99 to alumina in the column;

adding acid to the portion of the uranyl nitrate solution to achieve a pH of about 2 to about 5;

passing the portion of the uranyl nitrate solution at pH of about 2 to about 5, back into the reactor;

removing the fixed fission products from the alumina column through elution with a hydroxide; and precipitating the resulting elutriant with alpha-benzoinoxime for collecting the Molybdenum-99 as the medical isotope.

2. The method according to claim 1, wherein the uranyl nitrate solution is passed through the column of alumina for a period of time ranging from approximately 12 to 36 hours.

3. The method according to claim 1, wherein the solution contains U-235.

4. The method according to claim 1, wherein for about 20 liters of uranyl nitrate solution are in the reactor, the portion of the uranyl nitrate solution passing from the reactor being about 0.1 to 1.0 ml/per second.

5. The method according to claim 1, including washing the resulting elutriant with water before collecting the Molybdenum-99.

6. The method according to claim 1, wherein the hydroxide comprises one of sodium hydroxide and ammonium hydroxide.

7. The method according to claim 1, wherein for 20 liters of solution, the solution contains approximately 1,000 grams of U-235 in a 93% enriched uranium.

8. The method according to claim 1, wherein for 100 liters of solution, the solution contains about 2,300 grams of 20% enriched uranium-235.

9. The method according to claim 1, including passively cooling the reactor.

10. A system for collecting a medical isotope from a fission product produced in a nuclear reactor, comprising:

a vessel containing a selected quantity of uranyl nitrate solution as a homogeneous fissionable material for producing fission products including Molybdenum-99 in the uranyl nitrate solution at a 100 to 300 kilowatt power rating;

at least one alumina column, the fission products including Molybdenum-99 being fixable to alumina in the column;

means for directing a portion of the solution through the alumina column and thereafter back to the vessel;

means for adding acid to the portion of the solution before it is returned to the vessel and between the column and the vessel;

means for supplying a hydroxide through the column for eluting the fission products fixed to the alumina;

means for receiving the eluted fission products; and means for precipitating Molybdenum-99 from the fission products using alpha-benzoinoxime in the means for receiving the eluted fission products.

11. A system according to claim 10, including means for passively cooling the vessel.

12. A system according to claim 10, including means for washing the column.

13. A system according to claim 10, including an additional column and valve means connected to the first mentioned and additional column for supplying a stream of solution through only one of the columns at a time.

14. A system according to claim 10, wherein the vessel includes outwardly extending fins, the system including means for cooling the vessel comprising a pool of coolant fluid in which the vessel is immersed.

15. A system according to claim 10, wherein the selected amount of solution comprises 20 liters of solution, the solution containing approximately 1,000 grams of 93% enriched U-235.

16. A system according to claim 10, wherein the selected amount of solution comprises 100 liters containing about 1,000 grams of 20% enriched U-235.

* * * * *